US007071828B2

(12) United States Patent
Wong

(10) Patent No.: US 7,071,828 B2
(45) Date of Patent: Jul. 4, 2006

(54) WEARABLE BAND WITH MOTION DETECTION AND FLASHING LIGHTS

(75) Inventor: Wai Kai Wong, Haymarket (AU)

(73) Assignee: Cheerine Group (International) Pty. Ltd., New South Wales (AU)

( * ) Notice: Subject to any disclaimer, the term of this patent is extended or adjusted under 35 U.S.C. 154(b) by 229 days.

(21) Appl. No.: 10/088,757

(22) PCT Filed: Feb. 22, 2001

(86) PCT No.: PCT/AU01/00180

§ 371 (c)(1),
(2), (4) Date: Aug. 9, 2002

(87) PCT Pub. No.: WO01/62114

PCT Pub. Date: Aug. 30, 2001

(65) Prior Publication Data

US 2003/0030560 A1 Feb. 13, 2003

(30) Foreign Application Priority Data

Feb. 22, 2000 (AU) ..... PQ 5778

(51) Int. Cl.
*G08B 23/00* (2006.01)

(52) U.S. Cl. ..... 340/573.1; 340/689; 340/686.1; 362/103; 362/102

(58) Field of Classification Search ..... 340/573.1, 340/689, 686.1, 321, 286.01, 500; 362/103, 362/102, 800, 105
See application file for complete search history.

(56) References Cited

U.S. PATENT DOCUMENTS

| | | | | |
|---|---|---|---|---|
| 3,840,853 | A * | 10/1974 | Cukale | 340/432 |
| 4,412,205 | A | 10/1983 | Von Kemenszky | |
| 4,523,258 | A * | 6/1985 | Morse et al. | 362/108 |
| 4,791,536 | A | 12/1988 | James | |
| 5,339,294 | A * | 8/1994 | Rodgers | 368/67 |
| 5,457,900 | A * | 10/1995 | Roy | 362/103 |
| 5,463,537 | A * | 10/1995 | Trattner et al. | 362/103 |
| 5,758,947 | A * | 6/1998 | Glatt | 362/105 |
| 5,813,148 | A * | 9/1998 | Guerra | 36/137 |
| 5,903,103 | A * | 5/1999 | Garner | 362/103 |
| 5,934,784 | A * | 8/1999 | Dion | 362/103 |
| 6,106,130 | A * | 8/2000 | Harding | 362/103 |
| 6,112,437 | A * | 9/2000 | Lovitt | 362/103 |
| 6,213,619 | B1 * | 4/2001 | Yu | 362/103 |

FOREIGN PATENT DOCUMENTS

| | | |
|---|---|---|
| CA | 2024665 | 3/1992 |
| WO | WO 01/62114 A1 | 8/2001 |

OTHER PUBLICATIONS

PCT International Preliminary Examination Report for PCT/AU01/00180, dated Nov. 15, 2001, 3 pages.
International Search Report.

* cited by examiner

*Primary Examiner*—Jeffery Hofsass
*Assistant Examiner*—Daniel Previl
(74) *Attorney, Agent, or Firm*—Brinks Hofer Gilson & Lione

(57) ABSTRACT

A flashing device includes a wearable band having a motion switch for sensing movement of the band and generating a trigger signal in response to the movement, a circuit responsive to the trigger signal to generate an illumination signal, and at least one light which is illuminated in response to the illumination signal.

5 Claims, 3 Drawing Sheets

WEARABLE BAND WITH MOTION DETECTION AND FLASHING LIGHTS

BACKGROUND OF THE INVENTION

The present invention relates to a flashing device, and in particular to a device for intermittently illuminating a light or lights in accordance with the motion of a body.

Visibility is significantly reduced at night and in inclement weather conditions. In such conditions a person's ability to observe pedestrians or a cyclists, especially from a moving vehicle, will be diminished. As a result, the safety of pedestrians and cyclists is compromised.

In such conditions it would be advantageous if pedestrians and cyclists used articles of clothing or carried devices which illuminated them or signalled their position. There are several known systems which can perform such a task. One such a system incorporates lights with a shoe in such a way that every time the sole of the shoe is compressed during use a plurality of lights in the shoe illuminate. Such a system has limited utility since the lights are in the shoe, as the lights might not be seen from a distance due to their proximity to the ground. If it was raining, the lights may became submerged in water or covered in mud, thereby rendering the system ineffective for all intents and purposes.

A better safety device would be positioned higher on a person's body. This would maximise the distance in which a person could be seen. The higher position would also protect the device from, for example, pools of water and mud. It would also be advantageous to provide a device which can be used to display a person's body motion at spectator events, such as sporting events conducted at night.

SUMMARY OF THE INVENTION

In accordance with the present invention there is provided a flashing device comprising a wearable band having:

means for sensing movement of the band and generating a trigger signal in response to said movement;

circuit means responsive to said trigger signal to generate an illumination signal; and at least one light which is illuminated in response to said illumination signal.

Advantageously, the band may be worn on a user's head, neck, waist or arm, and movement of the user will cause the light or lights to flash.

Preferably the movement means includes a motion switch having a conducting sphere movable in the space defined by a plurality of conducting rods. Preferably the trigger signal is generated when said sphere moves into contact with at least two of said rods.

Preferably the circuit means includes an integrated circuit connected to the motion switch and mounted on a printed circuit board integrated in the band.

Advantageously, the lights may include LEDs distributed on the length of the band. The LEDs may include at least two sets of LEDs which are alternately illuminated when said trigger signal is generated.

BRIEF DESCRIPTION OF THE DRAWINGS

A preferred embodiment of the present invention is hereinafter described, by way of example only, with reference to the accompanying drawings wherein.

DETAILED DESCRIPTION OF THE INVENTION

Figure 1:
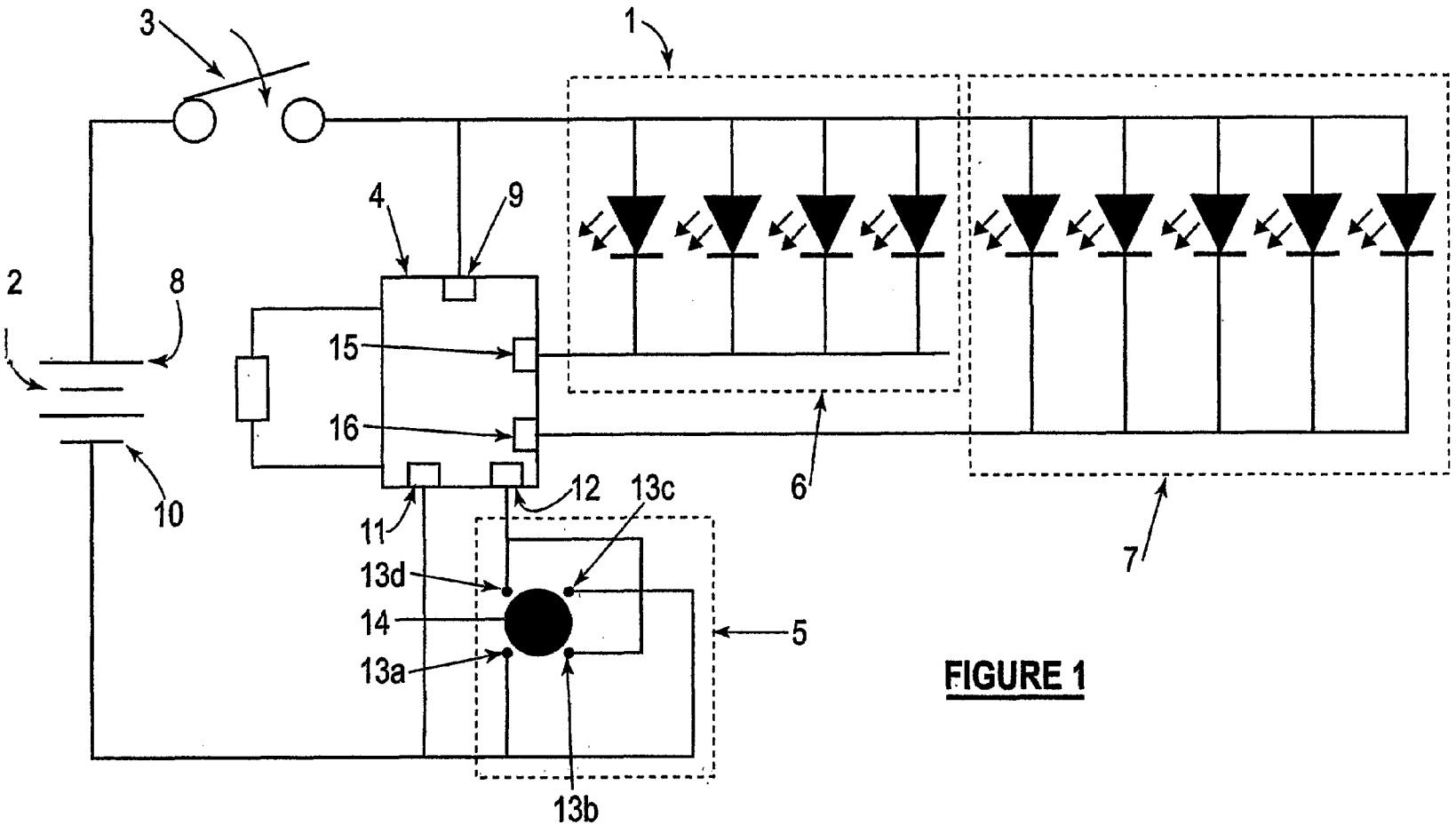
FIG. 1 is a circuit diagram of a preferred embodiment of a flashing device.
Figure 2:
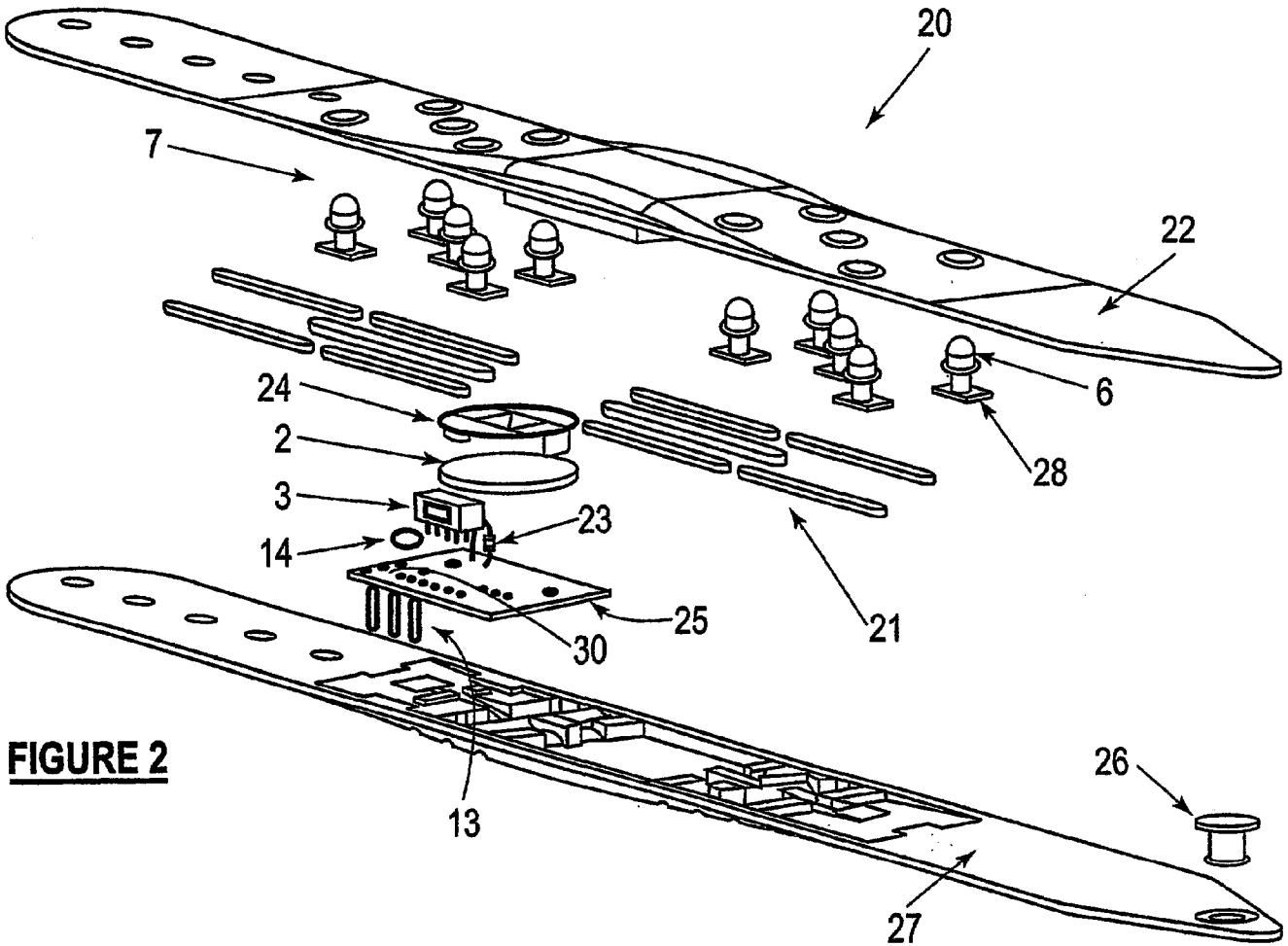
FIG. 2 is a schematic diagram of components of the flashing device shown in an exploded view.
Figure 3:
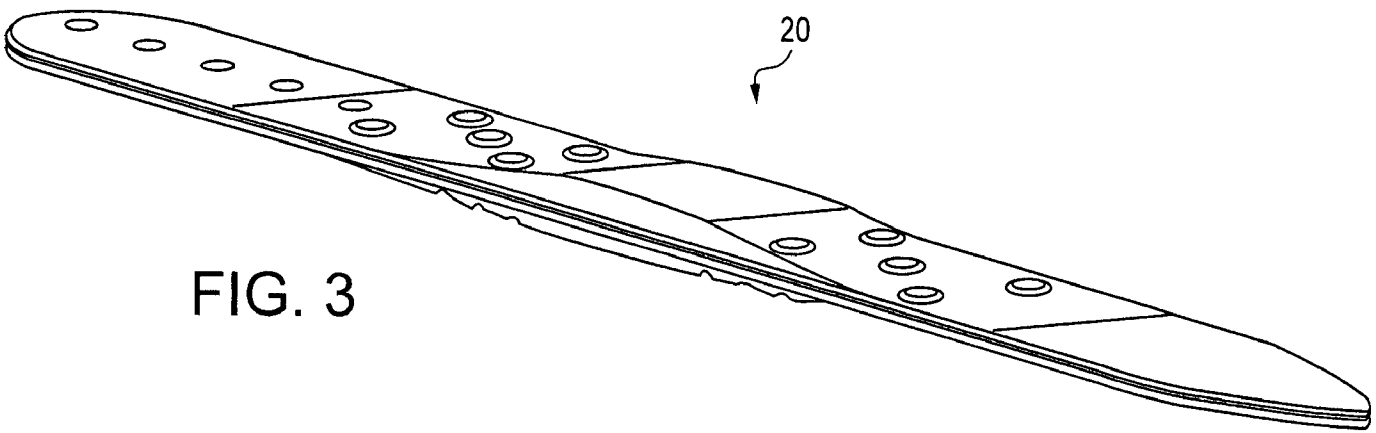
FIG. 3 is a perspective view of the flashing device of FIG. 2.

A flashing device 1, as shown in the drawings, includes a voltage source 2, a switch 3, an integrated circuit (IC) 4, a motion switch 5, a first plurality of light emitting diodes (LEDs) 6 and a second plurality of LEDs 7.

A terminal of the switch 3 is connected to the positive terminal 8 of the voltage source 2, and the other terminal of the switch 3 is connect to the IC 4 through an interface pin 9. The IC 4 is also connected to the negative terminal 10 of the voltage source 2 via an interface pin 11. When the switch 3 is closed the IC 4 will be considered 'on', or in a stand by mode.

The switch 3 may be constructed in such a way that once closed it will remain closed until such a time that the switch is physically opened. An example of such a switch is known as a 'slide switch'.

The IC 4 is also connected to the motion switch 5 via another interface pin 12. The motion switch includes four rods 13 (13*a*, 13*b*, 13*c*, 13*d*) and a sphere 14. The four rods 13 and the sphere 14 are constructed from a material which readily conducts electricity. An exemplary construction material may be steel. The sphere 14 may be a metal ball. The four rods 13 are mounted on a surface 30 in such a way that the rods are substantially perpendicular to the surface 30. The rods 13 are also positioned on the surface 30 in such a way that such that they form the corner points of a two dimensional square. In this configuration two rods 13*b* 13*d* which are diagonally opposite in the two dimensional square are connected to the interface pin 12 of the IC 4. The remaining two rods 13*a* 13*c*, also diagonally opposite in the two dimensional square, will be connected to the negative terminal 10 of the voltage source 2.

The four mentioned rods 13 are mounted on the surface 30 in such a way that the conducting sphere 14, when placed inside the two dimensional square, can contact any two rods, except for rods which are diagonally opposite, at any given time. The conducting sphere 14 when located in the centre of the two dimensional square does not be contact any rod. The surface 30 on which the rods 13 are mounted allows the sphere 14 to move freely in all directions and does not conduct electricity.

The motion switch 5 is said to be in an 'on' state when the conducting sphere 14 contacts two conducting rods and in an 'off' state otherwise. The IC 4 is said to be in a 'stand by' state when the switch 3 is closed and the motion switch 5 is connected and in an off state.

The IC 4 is connected via a first output pin 15 to a first plurality of LEDs 6. The LEDs 6 are connected in parallel between a first output pin 15 and the positive terminal 8 of the voltage source 2 via the switch 3. The IC 4 is also connected to a second plurality of LEDs 7 via a second output pin 16. The LEDs 7 are also connected in parallel between the second output pin 16 and the positive terminal 8 of the voltage source 2 via the switch 3.

When the motion switch 5 changes state from off to on the voltage at the interface pin 12 changes. The interface pin 12 is now effectively tied to the negative terminal 10 of the voltage source 2. The change of voltage experienced by the interface pin 12 acts as a trigger for the IC 4. After receiving this trigger the IC 4 may then selects an output pattern to be displayed and the output pin through which the pattern will be displayed. The IC 4 may alternately select between the two output pins to display the pattern.

When triggered, the IC 4 drives the selected output pin low in order to illuminate the LEDs connected to the pin. By driving the LEDs low the output pin effectively forms a current sink for the LEDs and illuminates them by allowing current to flow from positive terminal 8 of the voltage source 2, via the switch 3, through the LEDs to the current sink.

The IC 4 after having been triggered will stop illuminating the LEDs after a predetermined period of time. Accordingly, the LEDs are only illuminated or activated on triggering the IC 4, when the motion switch 5 changes state from off to on. The LEDs are therefore triggered when the sphere 14 moves between the rods 13, and causes the motion switch 5 to change state from on to off to on. Alternatively, the LEDs could remain illuminated while the motion switch does not change state.

In one embodiment of the invention, the first output pin 15 and the second output pin 16 are first and second output ports 15, 16 where each output port comprises a plurality of output pins. Each respective output pin of an output port may be connected to a plurality of LEDs, in parallel, where each respective plurality of LEDs is connected to the positive terminal 8 of the voltage source 2 via the switch 3 to its respective output pin.

In this embodiment of the invention, the IC 4 may alternately select an output port to generate an output signal when the motion switch changes state to on. The IC 4 may also select a pattern to be generated on the selected output port. The chosen pattern will dictate which pins on the output port are driven low. An output port pin which is driven low may act as a current sink for a respective plurality of LEDs attached to the pin thereby illuminating those LEDs.

In another embodiment of the invention the IC 4 may incorporate a delay which would allow the illuminated LEDs to remain illuminated for a finite amount of time after the motion switch 5 has changed state.

The IC 4 may be a standard LED driver circuit configured or programmed to illuminate the LEDs as described herein, or as desired, when the IC 4 is triggered.

Hereinafter, the motion sensing flashing device 1 is described as comprising a wearable band, being a cheerband 20. The device 1 is incorporated with a structure which allows the device 1 to be secured to a body.

The cheerband 20 includes wires 21 connecting the first plurality of LEDs 6 and the second plurality of LEDs 7, in parallel, to the IC 4. It also includes an upper mould of a band 22, a resistor 23, a printed circuit board 25, a battery holder 24, a plurality of bonding boards 28, a battery 2, a slide switch 3, a pin for the band 26 and a lower mould for the band 27.

In a preferred embodiment, the cheerband 20 would be secured to an arm or a wrist. In such an embodiment the mentioned arm or wrist would move intermittently. The movement of the conducting sphere 14 inside the motion switch 5 is governed by the movement of the arm or wrist. Therefore, the rate at which the motion switch 5 changes state and thus, the rate at which the IC 4 illuminates the LEDs is directly dependent on the arm or wrist movements. The result is that the cheerband 20 effectively flashes in accordance with arm or wrist movement.

The preferred material of the upper mould of the band 22 and the lower mould of the band 27 is plastic, such as 'Louie Flex'. This material is a non-toxic PVC substitute.

The cheerband 20, in addition to the safety features it can provide, can also be used as a fashion accessory. The cheerband 20 can also be used at sporting events, particularly night sporting events, to highlight the movement of spectators' arms, particularly when cheering, applauding or being involved in a "Mexican Wave".

Many modifications will be apparent to those skilled in the art without departing from the scope of the present invention as herein described with reference to the accompanying drawings.

What is claimed is:

1. A flashing device wearable by a person to display a person's body motion, the flashing device comprising:

a band configured to be detachably secured around a body part of the person, the band defining a cavity having a surface;

a plurality of light emitting diodes disposed for visibility on the band;

contained within the cavity, a flashing circuit comprising:

a voltage source, a motion switch including a conducting element movable in a space defined by a plurality of conducting parts, the motion switch closing to produce a trigger signal when the movable element contacts two adjacent conducting parts in response to body motion of a person wearing the flashing device, a control circuit having an interface pin coupled to the voltage source, an input pin coupled to the motion switch and one or more output pins coupled to the plurality of light emitting diodes, the control circuit responsive to receipt of the trigger signal at the input pin to generate a pattern of electrical signals at the one or more output pins for selectively illuminating the plurality of light emitting diodes in a flashing pattern.

2. The flashing device of claim 1 wherein the band comprises an upper mould and a lower mould which together define the cavity and which are joined to form the band.

3. The flashing device of claim 1 wherein the band is sized to be detachably worn on the person's wrist so that movement of the person's wrist controls the rate at which the motion switch closes and the rate at which the control circuit generates the pattern of electrical signals to illuminate the plurality of light emitting diodes in the flashing pattern.

4. The flashing device of claim 1 wherein the plurality of conducting parts comprises at least four electrically conducting rods extending substantially perpendicularly from the surface to form corner points of a square containing the conducting element, a first pair of diagonally opposing conducting rods being electrically coupled to the input pin of the control circuit and a second pair of diagonally opposing conducting rods being electrically coupled to the voltage source.

5. The flashing device of claim 1 wherein the control circuit is operative to stop illuminating the plurality of light emitting diodes after a predetermined period of time.

* * * * *